United States Patent [19]

Heaney

[11] 4,127,188

[45] Nov. 28, 1978

[54] FRANGIBLE DOOR CONTAINER

[75] Inventor: James J. Heaney, Glendale, Calif.

[73] Assignee: Anthony's Manufacturing Company, Inc., San Fernando, Calif.

[21] Appl. No.: 877,026

[22] Filed: Feb. 10, 1978

[51] Int. Cl.[2] ..... B65D 85/30; B65D 85/48

[52] U.S. Cl. ..... 206/453; 206/325

[58] Field of Search ..... 206/453, 325

[56] References Cited

U.S. PATENT DOCUMENTS

| | | | |
|---|---|---|---|
| 2,626,050 | 1/1953 | Freiberg | 206/453 |
| 3,321,075 | 5/1967 | Waller | 206/453 |
| 3,533,502 | 10/1970 | Hansen | 206/453 X |
| 3,720,035 | 3/1973 | Rutter | 206/453 X |
| 3,990,576 | 11/1976 | Heaney | 206/453 |

*Primary Examiner*—Davis T. Moorhead

*Attorney, Agent, or Firm*—Kleinberg, Morganstern, Scholnick & Mann

[57] ABSTRACT

A longitudinal sheet of paperboard has longitudinally aligned spacing elements for holding and containing substantially flat, frangible items resiliently spaced from each other. The sheet is adapted for wrapping the edges of the flat, frangible items for packaging and shipping. Rigid supports elevate the package above the floor for manipulation, as by fork lifts. A plurality of the sheets can be overlapped to form an adjustable, enlarged shipping container having a unique size adjusted to the size of the items packaged. The so-packaged items can be cinched tightly to form a tight, resilient shipping ensemble.

22 Claims, 6 Drawing Figures

FRANGIBLE DOOR CONTAINER

BACKGROUND OF THE INVENTION

1. Field of the Invention

This invention relates to the packaging and shipping art, and more particularly relates to containers for packaging and shipping substantially flat frangible items, such as glass doors.

2. Description of the Prior Art

The problems of shipping flat, frangible items, such as glass sheets and products containing glass sheets such as windows, doors and the like, have been with manufacturers and shippers for some time. In general, the problems revolve around attempts to prevent the frangible item from breaking, chipping or cracking. Many arrangements have been devised in the past to solve these problems. Many of these attempts significantly improved the packaging and shipping containers, and when taken individually or in conjunction with selected other attempts, have reduced the risk of breakage, cracking and chipping during storage and shipment.

Early attempts to solve the problem centered around securing the frangible items in as protective a covering as possible. Most often, such a protective envelope included rigid, hard containers usually made of wood or stronger material. The frangible items were arranged tightly within wood boxes or crates having stuffed therein a very large amount of packing material, such as excelsior, plastic form, newsprint, shavings, sawdust and the like.

Improvements were made in the particular wrapping arrangements securing the products within such boxes. One such improvement includes the interlocking of strips of paperboard so as to hold the strips in a folded, accordian-like position. The accordian-like paperboard is then secured around the entire periphery of the frangible product and acts as a packing between the frangible product and the shipping frame. A representative example of such packing can be seen in the patent to Freiberg, U.S. Pat. No. 2,626,050. Such packing arrangements, however, still require an all covering shipping container or carton which, for the most part, hides the nature of the frangible products being shipped.

Hereinafter in this description, the term "box" will be used interchangeably with, and is intended to have a meaning synonymous with the terms "carton" and "case". Also, the terms "cardboard" and "fibreboard" will be used interchangeably with the term "paperboard" to denote paper formed in a board-like fashion or pasted together in pasteboard.

With the nature of the products being shipped and packed hidden from view of the shippers and packers, breakage, chipping and cracking of the frangible products are not discovered until the package arrives at a customer's facility when the shipping and packing containers are unwrapped. Where, along the line from the manufacturing plant to the customer's receiving dock, the items was actually cracked, chipped or broken, can not be immediately determined. Aside from the issue of liability on the part of one or more of the shippers involved, there is an undesirable delay in supplying substitute frangible items.

If a frangible product were damaged enroute, and if it could be determined immediately after such damage that such had occured, the fact of such damage could be immediately conveyed to the manufacturer or the customer, and substitute products could be shipped at once.

Significant savings of time for often important and critical items in the manufacture of larger items could be realized. A builder of a building could more speedily have necessary windows; or, the builders of end items, such as refrigerated display cabinets, could have replacement doors supplied more speedily.

While such packaging arrangements improved the security of the frangible items, breakage continued to occur. It is reasoned that some of this breakage, cracking and shipping continued to occur because the armor-like cases, aside from hiding the nature of the product so-wrapped from the view of shipping and storing persons, created an image of invulnerability. Thus, these heavy wooden shipping containers were dropped from loading platforms, stacked unreasonably high one upon another, rammed by store room dollies and forklift trucks and otherwise handled in a manner in excess of the safety actually provided by the heavy wood crate. Indeed, the very weight of such shipping containers may have added to the difficulty in handling and thereby abetted shipping persons to mishandle the containers. Still, for very rigid structures such as glass doors, in small quantities, wood continues to be the material of choice. See J. F. Hanlon, *Handbook of Package Engineering* (1971), McGraw-Hill, at page 15-2.

Merely increasing the amount of packaging material and the thickness and weight of the outside, armor-like containers frequent results in only marginal risk improvement. Certainly adding such packing and crating material adds significantly to the weight, and substantially to the shipping costs.

It has been the state of the art and the custom of the industry, apparently, to accept the weight caused by wood or similar heavy boxes or crates for shipping frangible items, since it has been considered that maximum safety can be achieved with rigidity. If rigidity, stacking strength and protection from the hazards of shipping are essential, textbooks written by experts in recent years state that it is difficult to find a better material than wood. See *Handbook of Package Engineering* cited above, at page 15-3. The patented art showing rigid shipping containers and rigidly packed frangible items is quite developed.

Such rigid containers, however, have a serious drawback in that when they are manufactured, their dimensions are set and usually cannot be varied. Even in the fibreboard containers which are creased for later folding into a container, the dimensions of the ultimate container are preordained by the cut and the fold creasing scheme. Thus, if a group of differently dimensioned items are to be shipped, a separate set of wood boxes or paper slotted containers, commonly called an RSC, must be obtained for each different item size. Moreover, rigidity often means wood and abundant packing material. Shipping costs based on weight, and packing material costs combine to make it desirable to reduce the actual amount of material used in containing and in spacing such flat frangible products.

A significant improvement in the reduction of weight of frangible item shipping packages is described in U.S. Pat. No. 3,990,576 issued to the present inventor and assigned to the assignee of the present invention. Using the invention of that patent, a stack of frangible items is wrapped with a Sus-wrap material, a folded and slotted material for receiving the edges of the frangible items. The wrapped items are secured to a pallet and cinched with strapping means. That invention, while solving many problems, leaves some problems unresolved. The package results in some resiliency, particularly in the upper portions of the package. The resulting top part of the package, however, is such that stacking several packages on top of each other is not easily facilitiated.

As may be appreciated from a closer examination of the invention of that earlier patent to the present inventor, interiorly packaged doors in a package container may not necessarily rest upon the film, rigid pallet. It is possible that such interiorly packaged doors will rest only on the cardboard Sus-wrap suspended between the uppermost rails of the pallet. Such a suspension and attendant lack of wood support increases the risk of cardboard splitting with attendant weakening of the overall package container.

The above-identified earlier patent to the present inventor, further, contains a standard, rigid wood pallet having some five pieces of lumber. While the package container of that patent substantially reduces weight, it may be appreciated that it is always desirable to achieve further reduction in shipping weight as much as possible without sacrificing protection. It is also desirable to simplify and reduce the cost of the packaging materials as well as to increase the flexibility of the arrangement to package frangible objects having varying dimensions.

SUMMARY

In brief, in accordance with one aspect of the invention, an elongated sheet of standard size corrugated paper and paperboard is provided having the flutes of the corrugated paper oriented or aligned preferably perpendicular to the longitudinal direction. Narrow, elongated strips of paperboard and corrugated paper are arranged along a portion of one side of the larger, elongated paperboard. The narrow strips are aligned in the elongated or longitudinal dimension of the larger paperboard sheet, and preferably perpendicularly to the alignment of the flutes of the larger sheet to form a sheet section. The long, narrow strips of paperboard are spaced and arranged parallel to each other to define grooves for receiving edges of frangible items for packaging and shipment.

Opposite the large paperboard sheet from the narrow, long strips, rigid supports are positioned to run transversely from one side to the other of the large sheet. The rigid supports may be grooved to receive binding straps.

Two of the large paperboard sheet sections so constructed can be disposed in tandem, having adjacent longitudinal ends overlapping each other. The tandem connected sheets can have an overlap variably selected so that the defined grooves can be adjusted to encompass the end extent of the frangible item edges. Outside longitudinal ends of the tandem connected sheets then can be folded over the shorter edges of the frangible items.

A similarly constructed set of tandem connected sheets can be positioned across and over opposite longitudinal edges of the flat frangible items in its defined grooves. Outside end portions of the tandem connected sheets can then be folded over respective shorter end edges of the frangible items, and overlapped with the folded outside end portions of the first tandem connected set of sheets. The overlapped end portions then can be connected to form a package for the flat frangible items. Straps can be bound through the grooves in the rigid support and tightened to form a tight shipping package. Skids may be positioned, if desired, on the shorter, overlapped end portions, for example, for stacking the package, or for resting the package in warehouse facilities.

Any number of such sheets can be connected in series to form an edge protection for frangible items having an elongated edge. If the frangible item has a substantial secondary direction, additional sheets connected in series may be prepared for edges in the secondary dimension. Overlapping end portions from the sheets covering the primary edge dimension can be fastened or fixed to outer portions of the sheets covering the secondary edge dimension to form a unitary wrapping around the package. The amount of overlap can be varied to provide for an adjustability of the dimensions of the package so as to fit any set of uniformly dimensioned frangible items for shipment.

Other novel features which are believed to be characteristic of the invention, together with further objects and advantages thereof, will be better understood from the following description considered in connection with the accompanying drawings in which a preferred embodiment of the invention is illustrated by way of example. It is to be understood, however, that the drawings are for the purpose of illustration and description, and are not intended as a definition of the limits of the invention.

DESCRIPTION OF THE PREFERRED EMBODIMENT

Figure 1:
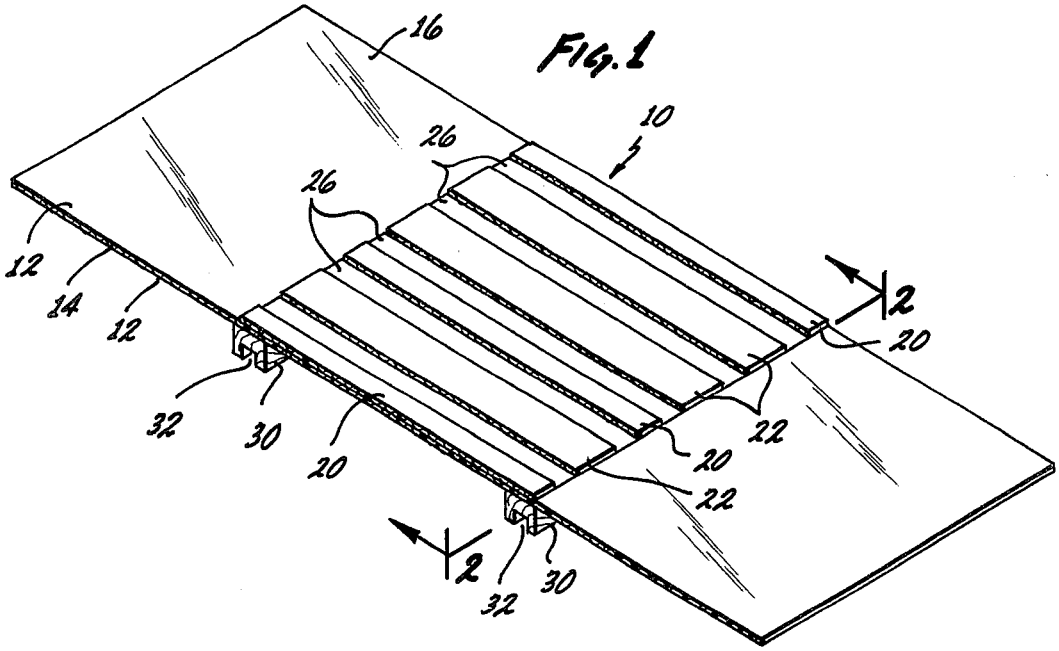
FIG. 1 is a perspective view showing one sheet section of the preferred embodiment of the invention.

A fundamental unit of the present invention comprising a sheet section 10 is shown, reference being had initially to FIG. 1 of the accompanying drawings. The section comprises two elongated sheets of paperboard 12 joined by corrugated paper 14 to form an elongated, unitary sheet 16. The flutes of the corrugated paper 14 are preferably arranged perpendicularly to the elongated dimension of the sheet 16. The corrugated medium may be formed having a standard flute scheme, for example in the range of from 36 to 96 flutes per foot.

The sheet 16 has placed along a portion of its longitudinal dimension a set of parallel, relatively narrow corrugated paperboard strips 20, 22 arranged parallel to each other. The strips 20, 22 form or define grooves 26 therebetween to receive the edge of frangible items to be packed. The grooves 26 have a uniform width and are aligned with the longitudinal dimension. When the frangible items such as glass doors are placed in the grooves, the items will form a stack of parallel, spaced items.

The strips 20, 22 may also have interleaved corrugated paper, as shown, having their flutes aligned transversely to the longitudinal dimension not only of the narrow strips but also of the sheet 16.

Strips 20 are narrower than strips 22. It is contemplated that the present package will be ideally suited for shipping refrigerated cabinet glass doors which will have handles affixed on one side. The glass doors can be packed having the handles extending into the space over the wider strip 22 without touching the adjacently stacked glass door. The backs of the glass doors can be packed facing each other, thereby permiting narrrower spacing as afforded by strip 20. The spacing of the glass doors will be discussed in greater detail below.

Arranged on the opposite side of the sheet 16 from the narrow strips 20, 22 are rigid support means 30. The rigid support means shown comprise a piece of wood extending from one side to the other of the sheet 16 transversely of the longitudinal dimension and in alignment with the flutes of the corrugated paper. A groove 32 is formed in the wood support for receiving a strap 36 (FIG. 2) for cinching or tying the package. The groove 32 should be deep enough to keep the strap 36 from protruding beyond the rails of the wood support 30.

Figure 2:
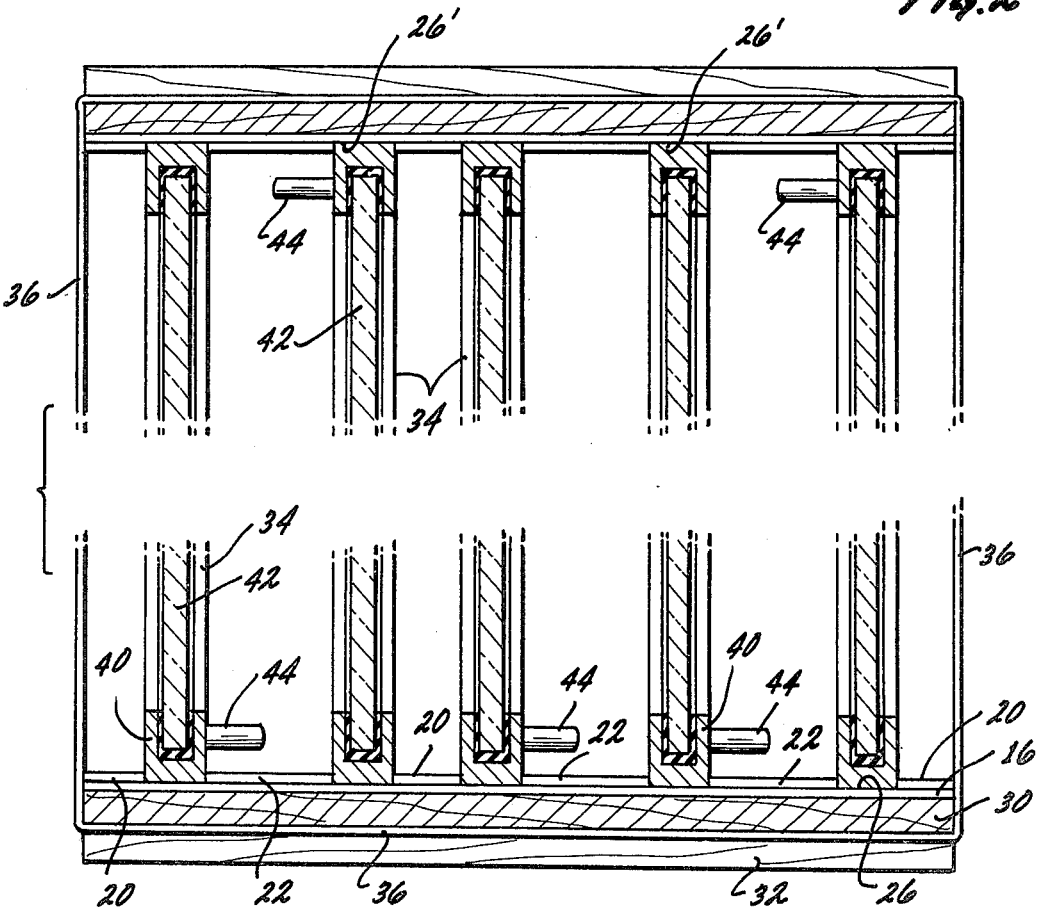
FIG. 2 is an elevation, cross-sectional view of FIG. 1 seen along line 2—2 in the direction of the arrows, having cross-sections of items to be packed shown in proper place.

FIG. 2 shows a cross-section of the sheet 16 of FIG. 1, having flat, frangible items such as glass doors 34 stacked and packed therein. The wood support 30 has a strap 36 threaded through the groove 32 to tighten the package. Each glass door 34 comprises a door frame 40 and glass pane 42. The door frames 40 have handles 44 attached thereto and extending into the space over the strap 22. The edges of the glass doors are fit within defined grooves 26. When the package is tightened securely, the strap 36 forces the paperboard 16 at great pressure against the edge of the door frame 40. The pressure should be sufficient to cause a slight indentation in the corrugated paper 14.

Because the flutes of the corrugated medium 14 are aligned perpendicularly to the edge of the door 34, as seen in FIG. 2, the flutes are transversely loaded. Their depression will not be as great, therefore, as in a situation where the flutes would be aligned with the edges of the door. The partial collapse of the corrugated medium 14 assures that there is a resiliency afforded to the packaging arrangement, thus incorporating a greater ability of the package to absorb shock which may be experienced during shipment and warehouse handling.

The flutes in the corrugated paper of the strips 20, 22 are aligned transversely to the alignment of the doors 34, to take advantage of the fact that corrugated paper or cardboard has greater strength in the dimension aligned with the flutes. This alignment of the flutes in the strips 20, 22 assures additional strength in the transverse or lateral dimension in order to provide greater strength and resistance to transverse or lateral movement of the doors 34 during rough handling.

The wood support 30 extends transversely under each of the doors 34. When the straps 36 are tightened, the corrugated paper and paperboard sheet 16 is compressed between each door 34 and the common wood support 30. Since all of the doors 34 rest on a common wood support 30, a common floor is established for the package and there is no door having only freely floating cardboard or paperboard supporting it. Of course, as will be explained in greater detail below, there are several such wood supports 30 supporting the doors 34 in a package. The sheet 16 is fastened to the wood support 30 preferably by nails, wire stitches or staples.

A nail or similar fastener is preferably utilized in each space defined by the narrow spacer strips 20, 22. Since there are a number of such spacer strips, it will be seen that such a fastening provides a substantially improved shear strength against forces tending to move the stack of doors laterally and off the supports 30. Such a shear stress might be encountered when a fork lift truck inserts tines under the space provided by the supports 30, but fails to stop before hitting the package.

It is contemplated that doors of varying length and width will be packaged using the concept of the present invention. While it is possible to have separate door package containers specially constructed having the precise dimensions of the varying door lengths, multiple sizes of the container must be separately ordered from the supplier. By using the concepts of the present invention, however, a single package section 10 may be ordered and connected with other, similarly constructed sections to form a unique package sized to the items to be shipped.

Figure 3:
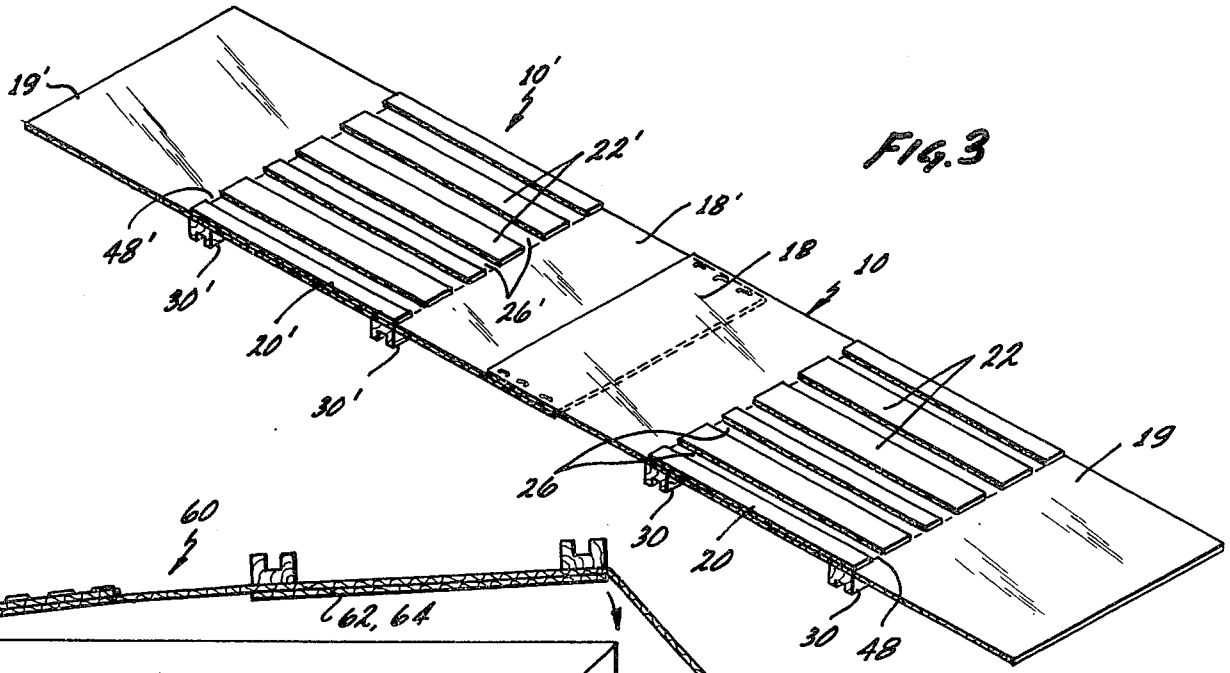
FIG. 3 shows in a perspective view, two of the sheet sections of FIG. 1 connected in overlapped tandem.

In FIG. 3, two sections 10, 10' are shown connected in tandem, an outer portion 18 of one section 10 overlapping an outer portion 18' of a second section 10'. The two sections 10, 10' are identical. Hereinafter for convenience in understanding the description of the tandem connected sections, the same reference numerals will be used for like elements in the two sections, except that the reference numerals of section 10' will have a prime affixed to the corresponding reference numeral for like elements.

The amount of overlap of the portions 18, 18' is determined by the length of the longer edge of the item to be packaged. In the preferred method of packaging, the longer edge of the items to be packaged should extend from the outer edge 48 of the grooves 26 to the outer edge 48' of the grooves 26'. In this tandem, there are four support means 30, 30' providing additional support to the stack of packaged items. The outer end portions 19 and 19' can be folded over along a crease at the edge 48, 48' of the grooves 26, 26' to engage the shorter edges of the stacked items.

Figure 4:
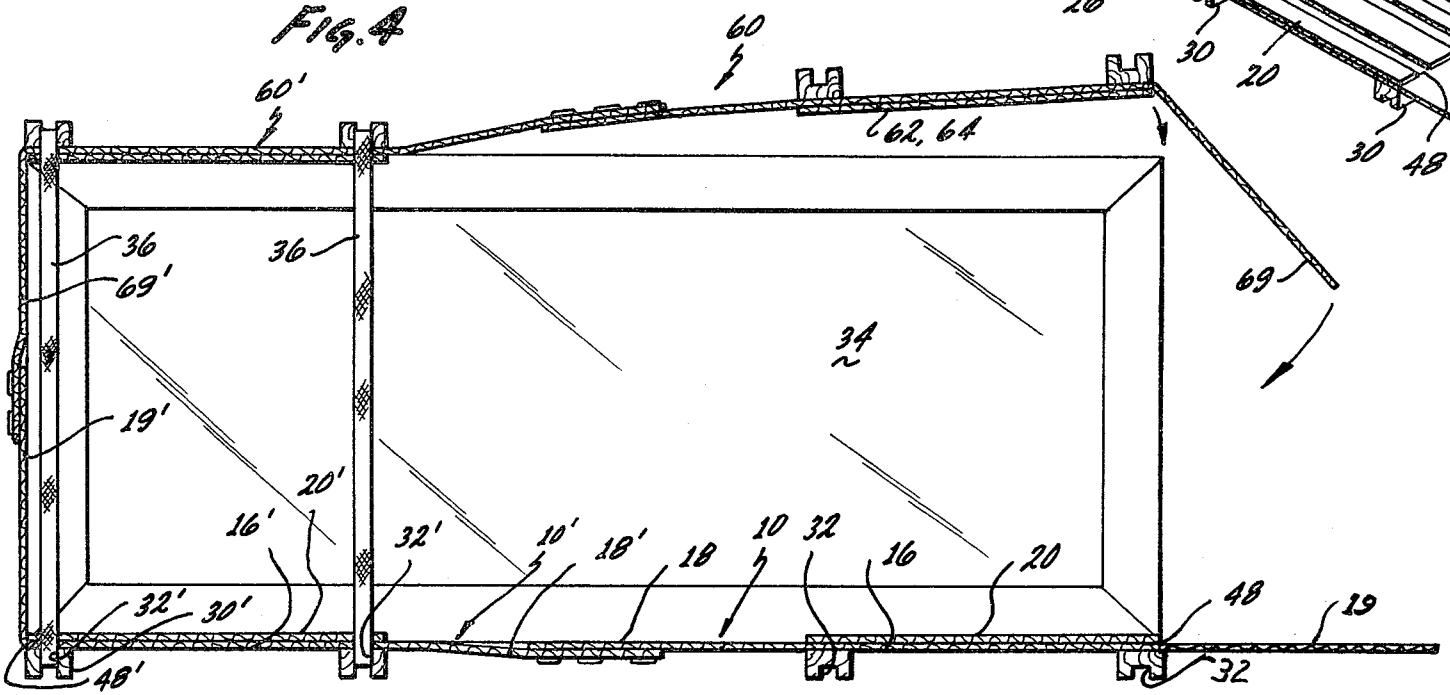
FIG. 4 is a side elevation view showing the package of the preferred embodiment partially completed.
Figure 5:
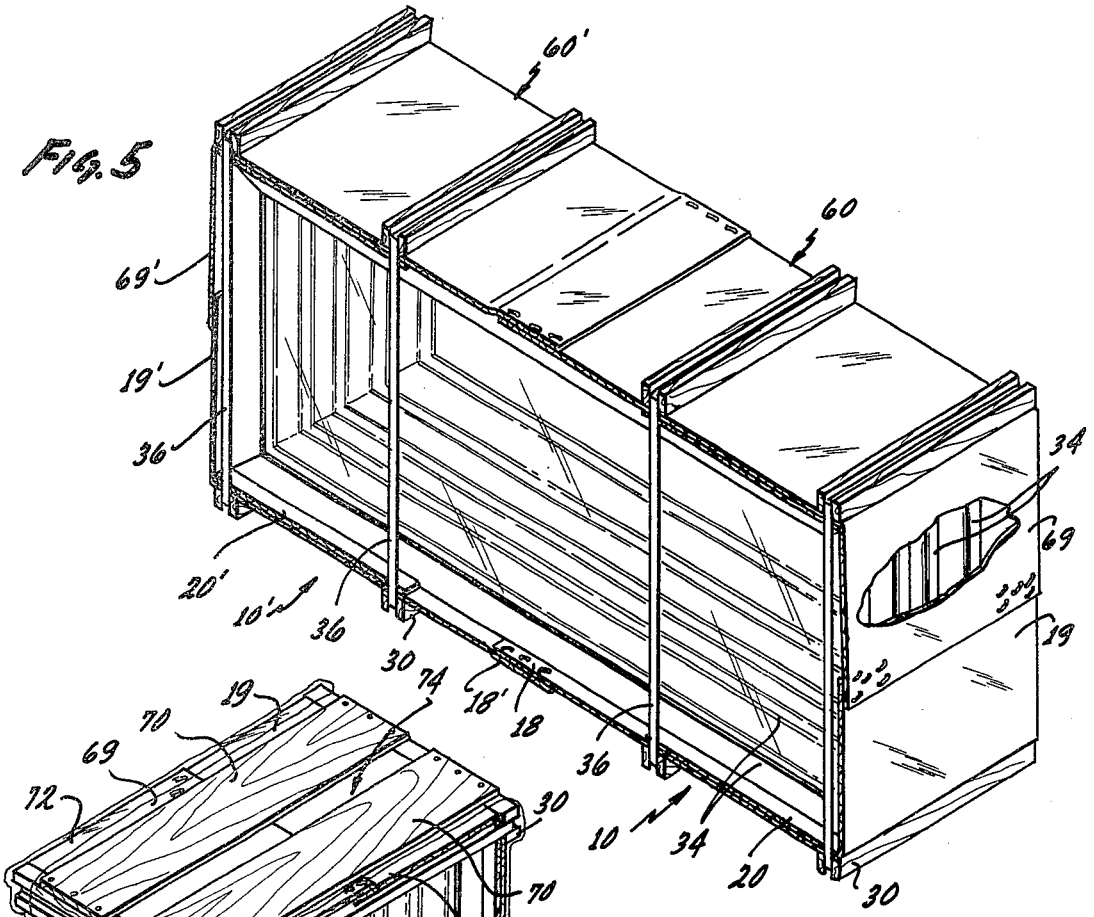
FIG. 5 is a perspective of the package of the preferred embodiment completed.

FIGS. 4 and 5 show the packaging of stacked items using the concept of the present invention. In FIG. 4, five glass doors 34 are arranged in parallel on two tandem connected sheet sections 10, 10'. The outer end portion 19' of section 10' is folded to engage the shorter edges of the stacked doors 34. The outer edge 19 of section 10 is shown laying horizontally preparatory to being folded to cover part of the opposite shorter edges of the doors 34.

A second set of tandem connected sheet sections 60, 60' are disposed on the upper side of the stack to engage the longitudinal edges of the doors 34 on the upper or opposite side from those edges engaged by the sections 10, 10'. An outer portion 69' of the section 60' is folded to engage the outer portion 19' and the remaining portions of the shorter edges of the doors 34 at that respective end. Individual straps 36 are strapped through the grooves 32, 32' and cinched tightly to compress the longitudinal edges of the doors into the corrugated paper and paperboard sheet 16, as explained above in the description for FIG. 2. This compression provides additional tightness to the package, while allowing some resiliency of the doors within the package.

FIG. 5 shows the stack of doors 34 of FIG. 4, having the outer portion 19 of the lower sheet section 10 folded upwardly to engage a portion of the shorter end edge of the doors. The outer portion 69 of the upper section 60 is folded downwardly to engage the remaining portions of the shorter edge of the doors 34, and to overlap the outer portion 19. The overlap is to be that amount sufficient to make the overall package fit the stacked items to be shipped.

Conventionally, it is preferred that the overlap be at least 1¼ inch and that the connection between the overlapped portions be sufficient to withstand dismemberment during shipment. The connection could be made by tape, by glue or by wire-stitching. It is considered in the trade that glue probably provides the strongest connection, but may be deleterious to glass and the like. Wire-stitching, on the other hand, provides a suitable fastening, and can be made in the spaces between the spaced doors 34 above and below the strips 20, 20', 22, 22', 62, 64 of the respective sections. The wire-stitching could take the form of wire staples or the like. A packager should be able to distinguish accurately the spaced sections from the portions of the cardboard which are covering the edges of the door. It may be desired nonetheless, to mark the sides of the paperboard 16 which will be exposed after wrapping the stack of doors, so that the position of the doors on the opposite side are known, and damage to the door itself with powered staples or other powered fastening devices will be obviated.

Figure 6:
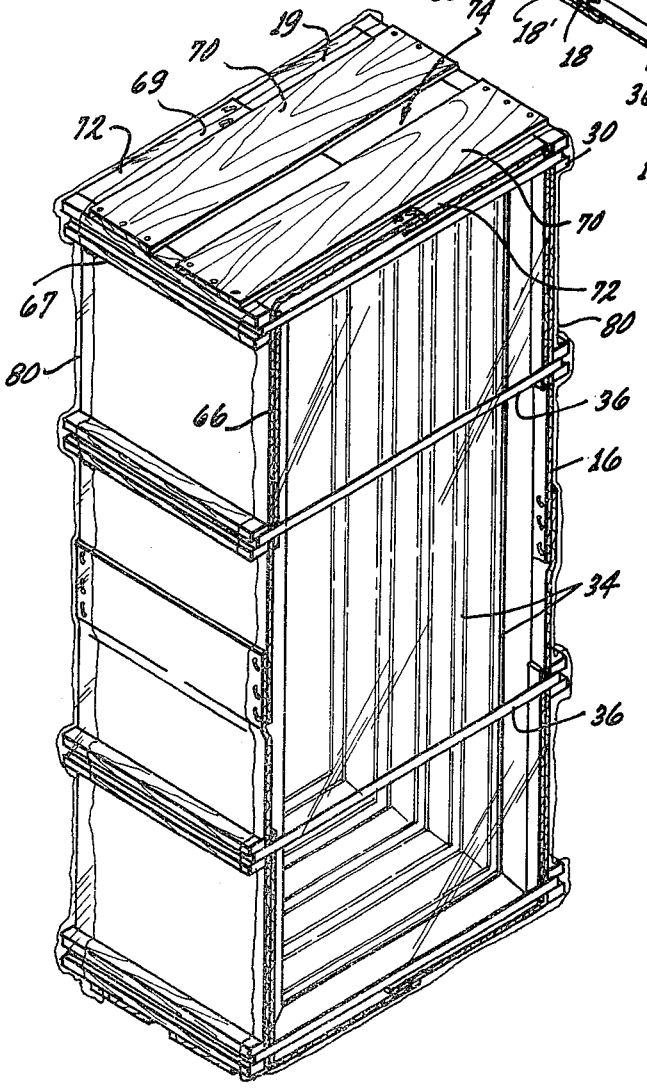
FIG. 6 is a perspective view of an end of the package of the invention in an alternative embodiment.

In FIG. 6, skids 70 are shown arranged on one of the shorter ends of the package in an alternative embodiment. The skids 70 in this alternative embodiment comprise a pair of wood slats having longitudinal dimensions aligned generally with the shorter end edges of the packaged items. The slats 70 should be spaced from one another sufficiently, and spaced from the outer edges 72 sufficiently to allow the forks of fork lift trucks or other material handling devices to be inserted between the end 74 and the floor or adjacently stacked package.

The slat skids 70 extend beyond the fold in the sheets 16, 66 to lie over the wood supports 30, 67. Fastening means, such as nails, staples, wire-stitching or the like can then be used to fasten the skids to the overlapped wood supports 30, 67. Such fastening will firmly establish end anchors for the skids. The overlap of outer portions 19, 69 will then be compressed to eliminate a bulge in the end of the package, and thus prevent any rocking which might otherwise occur.

A transparent plastic covering, such as transparent polyethylene sheet 80 may optionally be wrapped upon completion to cover that portion of the package leaving the doors exposed, as is shown in FIG. 6. The transparent sheet may be tightly bound to the package, or may be heat shrunk to closely fit about the package opening and cargo. The sheet 80 seals the interior of the package from foreign objects such as dirt and moisture, and helps maintain somewhat sanitary conditions for the cargo. The sheet 80 may be made of substantially thick transparent plastic so as to afford some protection against scratching and marring of the glass by foreign objects. In an alternative arrangement, a transparent plastic covering can be disposed completely enclosing the package. In such an arrangement, the skids 70 preferably would be placed outside the covering.

It can be seen that the present packaging method results in a structure having the flutes of the corrugated medium of the normally arranged package horizontal to the floor or ground, in contradistinction to the teachings of the art showing that the flutes should be arranged vertically for maximum strength. It has been found, however, that the present invention affords the greater safety for the frangible items, in that the frangible items are given a greater measure of resilient movement relative to each other, and also a greater resiliency to the overall package as explained hereinabove.

The resulting package can be stacked or positioned with the longer, longitudinal edges placed on the floor. Additional packages can be stored one on top of another, having the support means 30, 30' of the adjacent stacks in alignment and mutual contact. As many as three stacks of so packaged glass doors have been so stored with great efficiency and ease. The support means 30 provide a spacing between the package and the floor or adjacently stacked package for the insertion of tines of a fork lift truck or other material handling device. The package lying on its longitudinal end can be pulled or pushed across a rough surface or floor. The cinching straps 36 will be protected from being snagged and broken by their recess into the grooves 32.

It is contemplated that sometimes the number of glass doors in a stack will be less than the number of grooves prepared in the sheet sections. It might be desirable, nonetheless, to position one package of stacked doors on top of another package, even though the lower or bottom package may not have a full complement of glass doors in its stack. The transverse disposition of the wood support 30 will distribute the load of the upper package transversely across the lower package. This load distribution will be a result not only of the wood support of the top, covering sheet sections of the lower package, but also of the wood support of the bottom, lower sheet sections of the package on top. It will be appreciated that such a distribution of the load more evenly over the bottom package greatly improves the chances of integrity for the bottom package when the packages are stacked on each other, and one of the bottom packages does not have a full complement of glass doors.

Alternatively, the package can be stacked on its shorter, smaller ends, having the skids 70 abutting a floor or adjacent stack. The skids 70 will provide not only access for the tines of material handling devices, but will reinforce and further strengthen the end edge of the package.

By utilizing the methods shown in the present disclosure and its resulting novel structure, it can be seen that a package or container can be constructed from a plurality of identically or substantially similarly constructed package sections to create a package container that will precisely fit a stack of frangible items. The resulting package comprises a container wherein the frangible items are resiliently spaced one from another, and a container capable of withstanding shocks and other pressures without contact between the frangible items. The package is tight, resilient, efficient and fully satisfies all purposes of a container package to contain, to carry and to dispense the packaged goods. The present invention takes full advantage of the teachings the present inventor in his own, earlier patent, in that the frangible nature of the packaged goods is fully exposed to shipping and handling personnel along the shipping route, but in a much more adaptable container structure and a more efficient method of packing the goods.

The foregoing detailed description is illustrative of the preferred embodiment of the present invention. It is to be understood, however, that additional embodiments will be perceived by those skilled and familiar in the art. The embodiments described herein together with those additional embodiments are considered to be within the scope of the present invention.

What is claimed is:

1. A packaging container adapted for shipping frangible items in spaced relationship while leaving flat sides of the items exposed to view comprising:

first elongated paperboard sheet means including a unitary longitudinal sheet of paperboard adapted to bend about edges of said frangible items, said sheet having a longitudinal dimension, said means further including a plurality of relatively narrow paperboard strips arranged generally parallel to and spaced from each other and disposed fastened to said longitudinal sheet defining grooves for receiving individual edges of said frangible items and for maintaining said frangible items in spaced relationship, said longitudinal sheet of paperboard having outer portions adapted for bending over shorter edges of said frangible items;

said paperboard sheet means further including rigid support means secured opposite said paperboard sheet from said narrow paperboard strips, for distributing the load of said frangible items transversely across said paperboard sheet means, said rigid support means including a rigid support member oriented substantially perpendicular to said longitudinal dimension;

means for tightening said sheet means around said frangible items; and second elongated paperboard sheet means adapted for engaging frangible item edges opposite the edges received by said grooves of said first sheet means, said second sheet means including a longitudinal sheet of paperboard substantially similar to said first means longitudinal sheet of paperboard having outer portions adapted for bending over the shorter edges of said frangible items.

2. The packaging container of claim 1 wherein said unitary longitudinal sheet of paperboard is creased at two lines to form a center portion and two outer portions, and wherein said additional layers of paperboard are arranged substantially along the length of said center portion, and wherein the outer portions of said second sheet are adapted for overlapping and securing to said outer portions of said first sheet when said first sheet outer portions engage edges of said frangible items.

3. The packaging container of claim 1 wherein said unitary longitudinal sheet of paperboard comprises cardboard.

4. The packaging container of claim 3 wherein said unitary longitudinal sheet of paperboard comprises corrugated cardboard.

5. The packaging container of claim 1 wherein said rigid supports have grooves formed therein for receiving straps.

6. The packaging container of claim 1 adapted for shipping substantially flat, frangible transparent items.

7. The packaging container of claim 1 wherein said first elongated paperboard sheet means includes a first and a second said unitary, longitudinal sheets of paperboard, an outer portion of the first longitudinal sheet overlapping and fastened to an outer portion of said second longitudinal sheet and the grooves of said first longitudinal sheet being aligned with the grooves of said second longitudinal sheet, the amount of overlap determining a distance including the grooves of said first and said second sheets to be comparable to the length of said individual edges of said frangible items; and wherein said second elongated paperboard sheet means includes a first and a second said longitudinal sheets of paperboard substantially similar to each other, an outer portion of said first sheet overlapped and fastened to an outer portion of said second sheet, said grooves of said first sheet and of said second sheet being aligned to define a length including said grooves comparable to said frangible item individual edges.

8. The packaging container of claim 7 wherein said first elongated paperboard sheet means and said second elongated paperboard sheet means each includes a plurality of more than two said unitary longitudinal sheets connected in series.

9. The packaging container of claim 4 wherein flutes of said corrugated cardboard are aligned transversely to the longitudinal dimension of said longitudinal sheets of paperboard.

10. A glass sheet shipping ensemble having a plurality of glass sheets arranged in parallel, spaced relation to each other, and each exposed to view, comprising:

a plurality of glass sheets having edges, and arranged generally in parallel to each other;

a plurality of substantially similar unitary longitudinal sheets of paperboard creased about said glass sheet edges, each said sheet having additional layers of paperboard attached to that respective said sheet along at least a portion of the longitudinal dimension, said additional layers being positioned between said glass sheets to form a spacer element spacing said glass sheets relative to each other;

rigid support means for elevating said ensemble and for supporting said emsemble, said support means including at least two rigid supports attached to at least one said unitary sheet opposite from its respective said additional layers, and said supports arranged substantially transverse to said edges of said glass sheets; and means tightly cinching said ensemble about the outside of said unitary sheet and said rigid supports.

11. The unitary sheet of claim 10 wherein said unitary longitudinal sheet comprises corrugated paper and paperboard.

12. The shipping ensemble of claim 10 wherein said cinching means include straps.

13. The shipping ensemble of claim 10 wherein each said rigid support includes grooves formed therein for receiving straps.

14. The shipping ensemble of claim 13 wherein said straps are tightened about said unitary sheet and said rigid supports transversely to the alignment of said plurality of sheets.

15. The shipping ensemble of claim 11 wherein the flutes of said corrugated paper are aligned transversely in relation to said longitudinal dimension.

16. The shipping ensemble of claim 10 wherein said glass sheets are substantially similar to each other.

17. An adjustable packaging container adapted for shipping substantially flat frangible items in substantially parallel, spaced relationship and exposed to view comprising a plurality of identical pasteboard sections, each said section comprising:

a sheet of pasteboard having a longitudinal dimension adapted to bend around edges of said frangible items;

a plurality of pasteboard strips disposed in spaced, parallel relationship along a portion of said sheet aligned with its longitudinal dimension to define grooves;

rigid supports attached to said sheet opposite from said strips and oriented transverse to said longitudinal dimension.

18. The adjustable packaging container of claim 17 wherein said plurality of sections comprises two.

19. The adjustable packaging container of claim 17 wherein each said section comprises a center portion defined by said strips and two outer portions extending longitudinally from said center portion.

20. The adjustable packaging container of claim 19 wherein said plurality of sections comprises four, and said frangible items comprise substantially rectangularly shaped items, the packaging container comprising a first and a second of said sections disposed covering one of the longer edges of the items, an outer portion of said first section being overlapped onto an outer portion of said second section; the packaging container further comprising a third and a fourth of said sections disposed covering the other of the longer edges of the items, an outer portion of said third section being overlapped onto an outer portion of said fourth section; each remaining outer portion of the respective sections being folded over one of the shorter edges of said frangible items and overlapping another of said remaining outer portions.

21. The adjustable packaging container of claim 20 wherein the remaining outer portion of said first section overlaps the remaining outer portion of said third section to cover one of the shorter edges of the items; said container further comprising skids positioned over said overlapped first section and third section overlapped portions.

22. The adjustable packaging container of claim 21 wherein said skids comprise a pair of rigid slats aligned with said edges of the items.

* * * * *